US008347672B2

(12) United States Patent
Habecke

(10) Patent No.: US 8,347,672 B2
(45) Date of Patent: Jan. 8, 2013

(54) LOCK CYLINDER PARTICULARLY FOR FUNCTIONS WHICH CAN BE CARRIED OUT IN A VEHICLE

(75) Inventor: Matthias Habecke, Hattingen (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 141 days.

(21) Appl. No.: 12/451,599

(22) PCT Filed: Feb. 20, 2008

(86) PCT No.: PCT/EP2008/001335

§ 371 (c)(1),
(2), (4) Date: Nov. 19, 2009

(87) PCT Pub. No.: WO2008/141683

PCT Pub. Date: Nov. 27, 2008

(65) Prior Publication Data

US 2010/0064743 A1 Mar. 18, 2010

(30) Foreign Application Priority Data

May 19, 2007 (DE) ..... 10 2007 023 458

(51) Int. Cl.
*E05B 13/10* (2006.01)

(52) U.S. Cl. ..... 70/189; 70/222; 70/223; 70/379 R; 70/380; 70/422

(58) Field of Classification Search ..... 70/379 R, 70/379 A, 380, 422, 218, 222, 223, 188, 189, 70/DIG. 42, 149, 419
See application file for complete search history.

(56) References Cited

U.S. PATENT DOCUMENTS 4,773,240 A * 9/1988 Foshee ..... 70/222
4,854,143 A * 8/1989 Corder et al. ..... 70/218
4,947,664 A * 8/1990 Lindmayer et al. ..... 70/422
5,070,716 A * 12/1991 Whorlow ..... 70/492
5,263,348 A * 11/1993 Wittwer ..... 70/379 R
(Continued)

FOREIGN PATENT DOCUMENTS

DE 3827418 2/1990
(Continued)

*Primary Examiner* — Lloyd Gall
(74) *Attorney, Agent, or Firm* — Horst M. Kasper

(57) ABSTRACT

In order to enable a turning of a key of a lock cylinder onto a driven member (shaft 36) in the lock cylinder only when a proper key is inserted, yet to prohibit the turning in case of an overload, an overload lock is arranged therebetween. The driven member (shaft 36) should specifically actuate functions in the vehicle only if the correct key is used. A threshold rotation torque determines the change between the normal and the overload state. In order to improve the lock cylinder, it is furnished that a disengaging lever (40) is mounted in the cylinder housing (30) in a pivotable manner (42) and can be displaced between two pivot positions in a radial plane defined by the longitudinal axis (13) of the lock cylinder. A locking cam (41) belonging to the overload lock is arranged on the free end of the disengaging lever (40). When the disengaging lever pivots, a carrier (50) pivots in unison, the carrier having a coupling part which engages in a counter coupling part of the cylinder core (10) during normal function. The disengaging lever (40) and the carrier (50) form a common pivot unit. In case of overload, wherein a rotation of the cylinder core force, the carrier (50) is decoupled from the cylinder core (10).

22 Claims, 4 Drawing Sheets

U.S. PATENT DOCUMENTS

Figure 3:
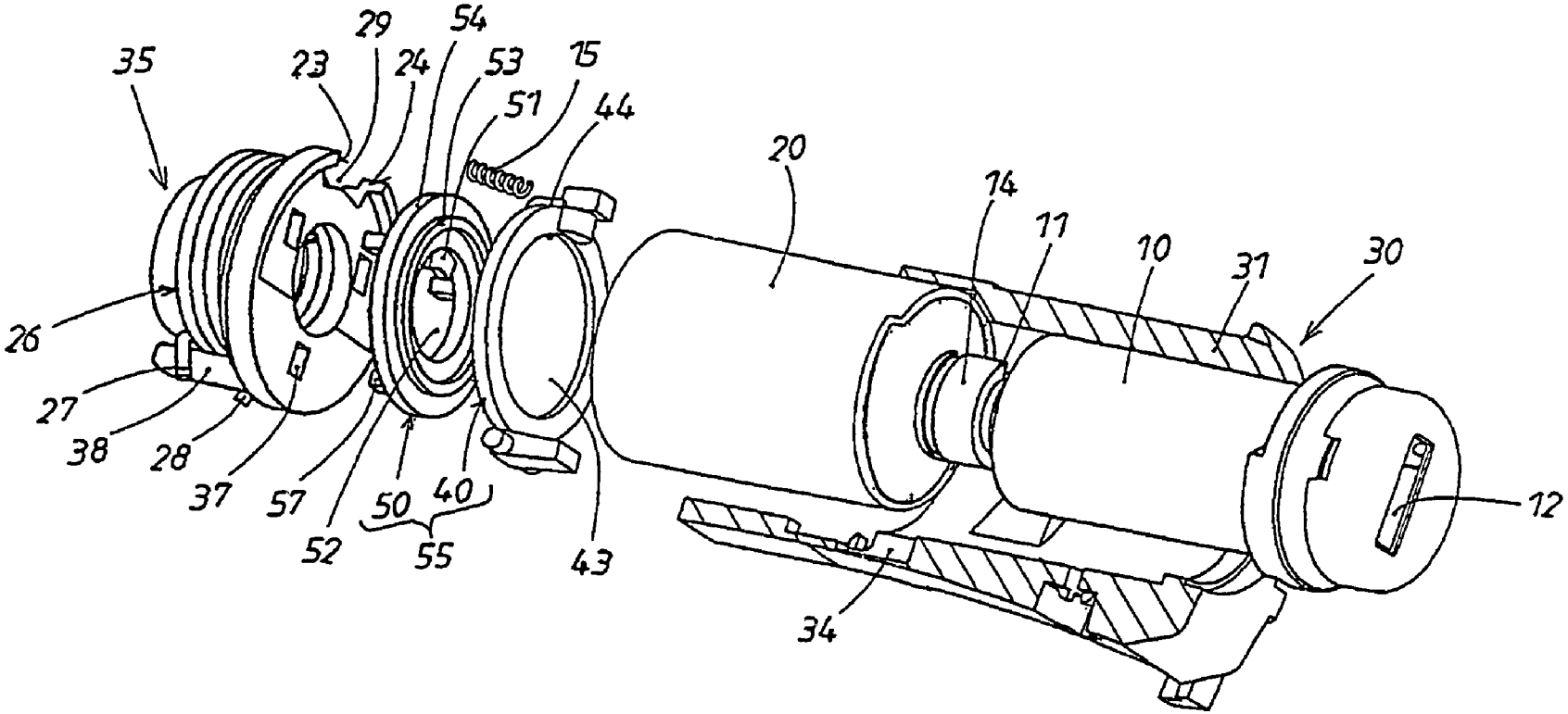

| | | | | |
|---|---|---|---|---|
| 5,265,453 | A * | 11/1993 | Konii et al. | 70/379 R |
| 6,425,275 | B1 * | 7/2002 | Geurden | 70/422 |
| 6,523,382 | B1 * | 2/2003 | Dimig et al. | 70/496 |
| 6,978,645 | B2 * | 12/2005 | Shimon | 70/379 R |
| 7,472,570 | B2 * | 1/2009 | Yamaguchi et al. | 70/379 R |
| 7,536,887 | B2 * | 5/2009 | Makino | 70/379 R |
| 7,997,108 | B2 * | 8/2011 | Flandrinck | 70/379 R |
| 7,997,109 | B2 * | 8/2011 | Flandrinck | 70/379 R |
| 8,011,215 | B2 * | 9/2011 | Flandrinck | 70/379 R |

FOREIGN PATENT DOCUMENTS

| | | |
|---|---|---|
| DE | 4410783 | 4/1995 |
| DE | 4408910 | 9/1995 |
| DE | 19604350 | 9/1996 |
| DE | 149639251 | 12/1997 |
| DE | 13639248 | 1/1998 |
| DE | 19749325 | 7/1999 |
| DE | 10212798 | 1/2003 |
| DE | 69907311 | 5/2003 |
| DE | 10346956 | 4/2005 |
| EP | 0151081 | 8/1985 |
| EP | 0769537 | 4/1997 |

* cited by examiner

FIG.1
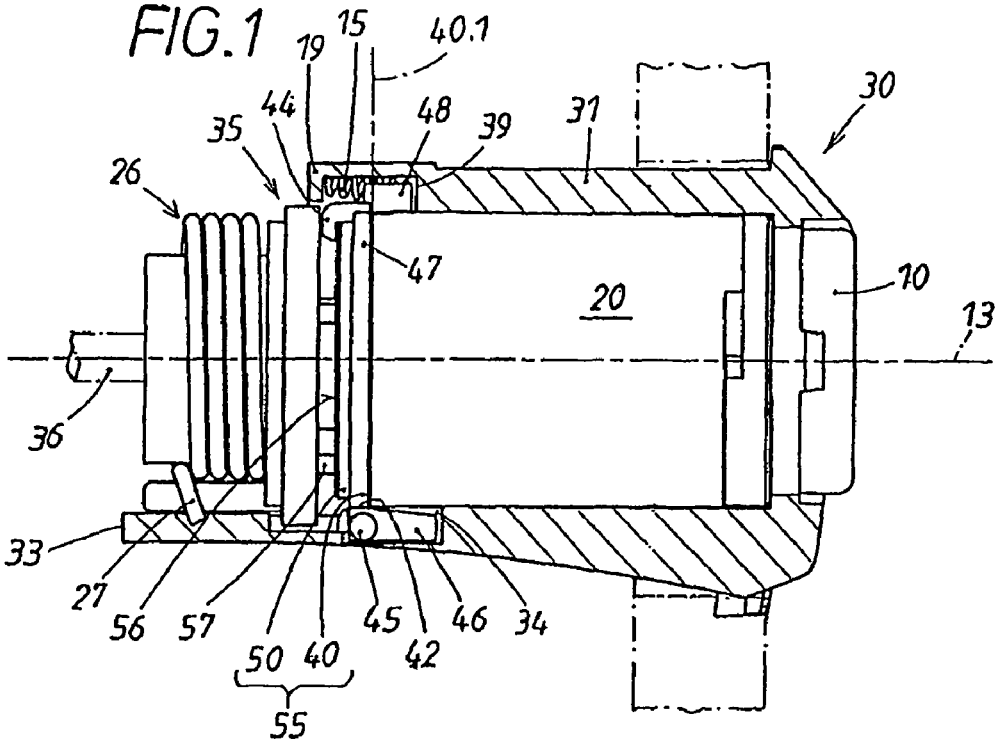
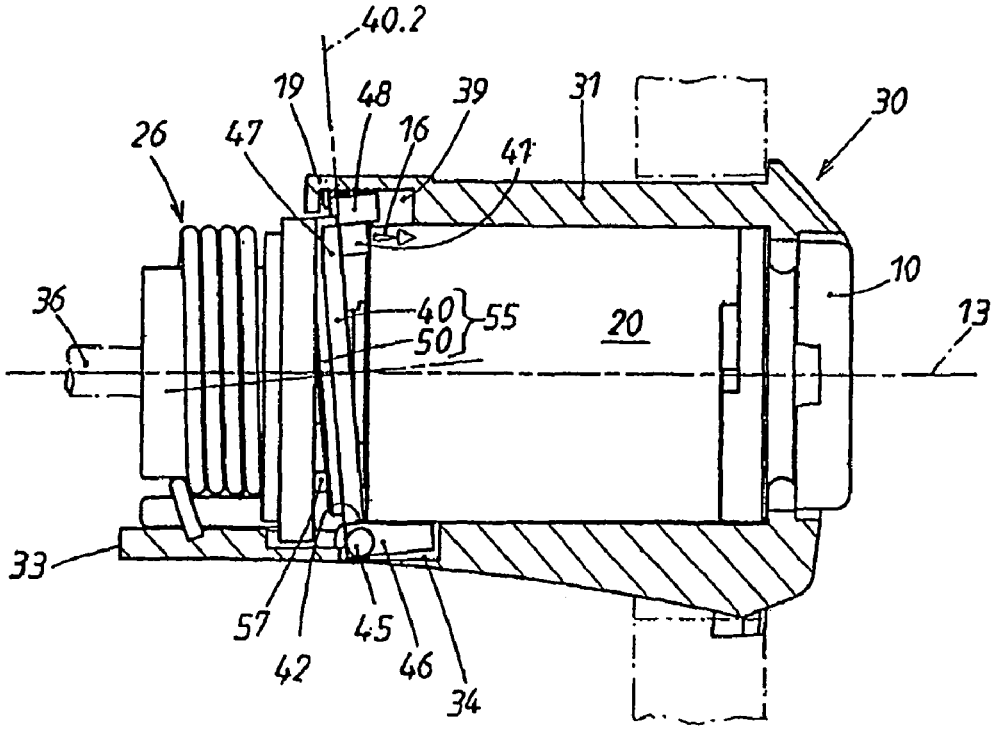
FIG.2

FIG.5
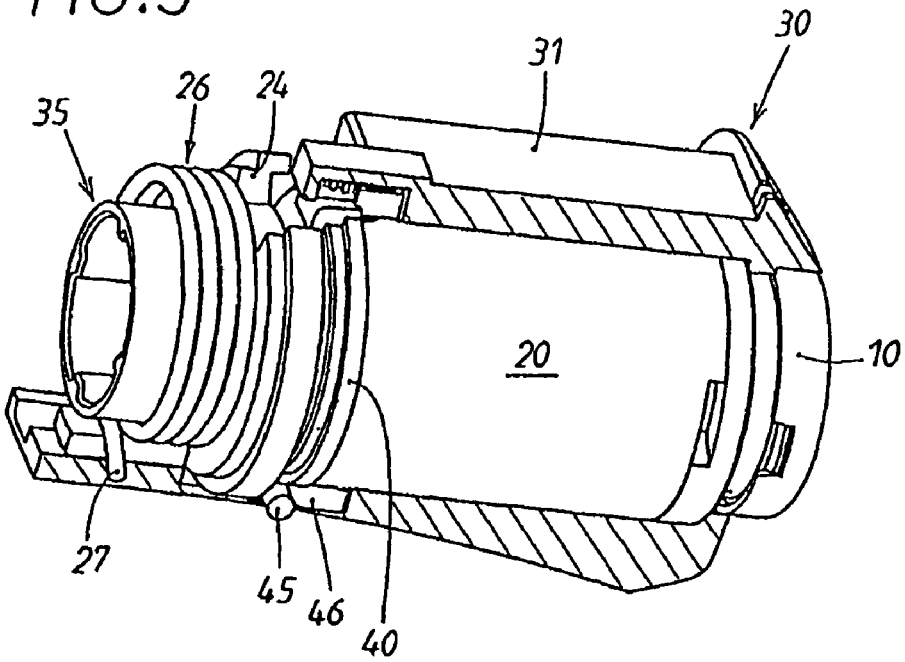
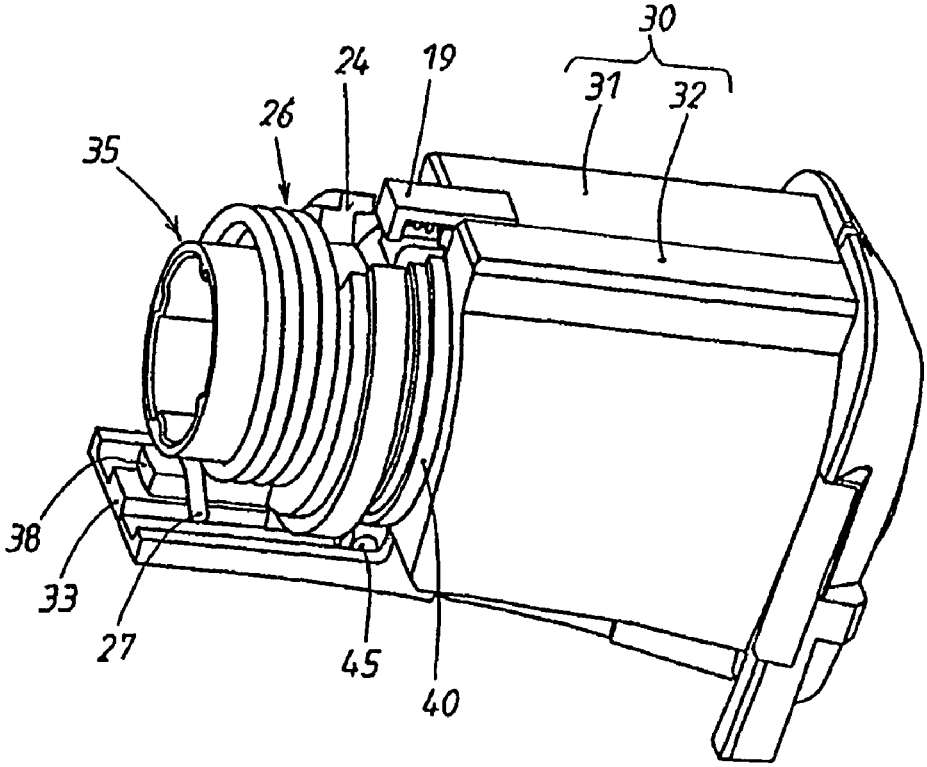
FIG. 6

LOCK CYLINDER PARTICULARLY FOR FUNCTIONS WHICH CAN BE CARRIED OUT IN A VEHICLE

BACKGROUND OF THE INVENTION (1) Field of the Invention

The invention is directed to a closing cylinder with a cylinder core for insertion of a key for resetting closing followers in the cylinder core from their blocking engagement in a bearing sleeve. The there provided overload blocker is to protect the closing cylinder against damages, in case unauthorized persons perform forced rotations at the cylinder core by way of a break-in tool. The overload blocker responds to a certain limiting torque. In a normal case, at a rotation of the cylinder core by way of a proper key, the torque is transferred to a drive member of the closing cylinder, which drive member performs the desired functions at the vehicle. If however the limiting torque has been surpassed by forced rotations without key, then the overload blocker passes into an overload case, where the torque does not pass to the driven member of the closing cylinder based on internal decoupling. Then no function is performed in the vehicle. The cylinder core together with the bearing sleeve fixed against rotation relative to the cylinder core is idle running.

(2) Description of Related Art including information disclosed under 37 CFR 1.97 and 1.98

The German patent document DE 38 27418 C2 shows such a closing cylinder. Here the overload blocker comprises a release sleeve with a sliding claw connected in fact axially fixed but rotatable to the release sleeve. The sliding claw has a coupling part, which engages a counter coupling part of the closing cylinder based on a spring force. Profiled locking cams and counter profiled locking recesses are disposed between the release sleeve and a bearing sleeve, wherein the release sleeve is shifted parallel between its normal position and its overload position through the locking recesses. A helical spring encloses a core piece of the driven member and of the sliding claw and takes care of a pressure on all sides between an inner flange of the release sleeve and an outer flange of the sliding claw. Also the sliding claw is shifted parallel thereby during a transition from the normal case to the overload case.

The locking cams effective for decoupling the carrier relative to the closing cylinder and the locking recesses between the release member and the bearing sleeve have to be kept small for reasons of space limitations in the known closing cylinder. Therefore various different limiting torques result with a production of the known closing cylinder. The straying of these values makes it more difficult to furnish a guarantee relative to the functional security of the closing cylinder.

BRIEF SUMMARY OF THE INVENTION

1. Purposes of the Invention

It is an object of the present invention to develop a function secured closing cylinder, wherein the overload blocker of the closing cylinder is improved. This is achieved by the following features, which have the following particular importance.

2. Brief Description of the Invention

The invention employs a release lever, which release lever is swivel supported at its one circumferential position in the cylinder casing, as a release member. The release lever transitions in an axial plane between two swivel positions upon the transition between the normal case and the overload case. The release lever is combined with the carrier to a swivel unit capable of a common swivel motion. The locking cam or, respectively, the locking recess is disposed at a circumferential position, which circumferential position is disposed opposite to the swivel bearing position of the release lever. The swivel bearing position is kept spatially fixed during the transition between the normal case and the overload case, and for that reason more space remains at the oppositely disposed circumferential position. Therefore in case of a predetermined available space in the closing cylinder, the axial height of the locking cam and of the locking recess can be formed larger as with the known, parallel shiftable release member. Based on the larger formation, the production tolerances play a lesser role. Therefore the limiting torque is nearly constant in the context of the present invention.

BRIEF DESCRIPTION OF THE SEVERAL VIEWS OF THE DRAWING(S)

Figure 4:
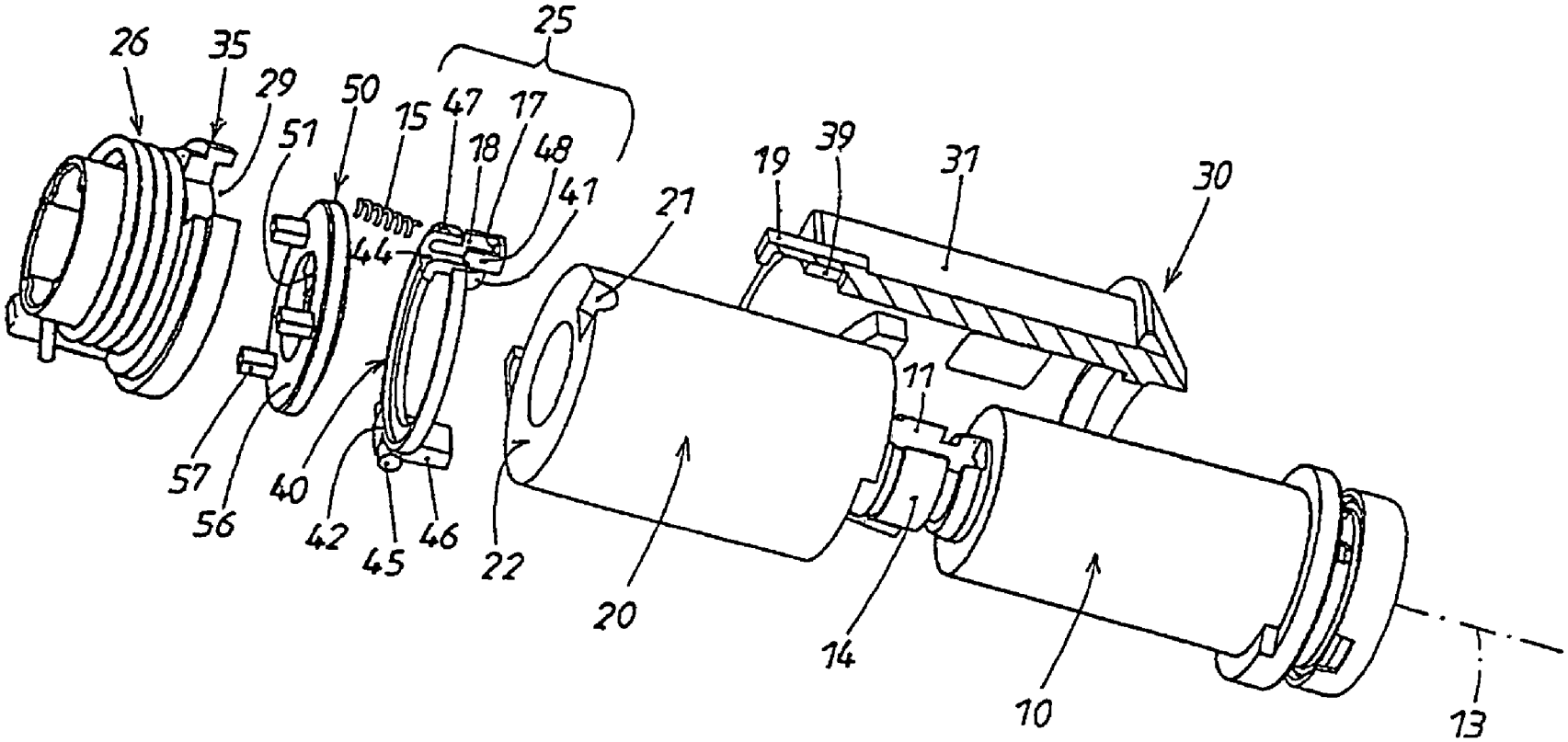

Further features and advantages of the invention result from the further claims, the following description and the drawings. An embodiment example of the invention is presented in the drawings. There is shown in:

FIG. 1 is a partial longitudinal section of the closing cylinder of the present invention in the normal case of the overload blocker, FIG. 2 is the longitudinal sectional view of the closing cylinder analogous to FIG. 1 in the overload case of the overload blocker, FIG. 3 is a perspective explosive view showing the components of the closing cylinder of FIGS. 1 and 2 with a view onto the outer front end of the cylinder core, where only one-half of the cylinder casing is shown, FIG. 4 is a perspective explosive view of the components analogous to the view of FIG. 3, however with a view onto the inner end of the device group, FIG. 5 is a perspective view of the device components of the closing cylinder shown in FIG. 1, wherein the cylinder casing of the closing cylinder is longitudinally subdivided into two casing shells, of which shells one was dispensed with, and FIG. 6 is a perspective view analogous to FIG. 5, where the two casing shells of the cylinder casing are connected to each other.

DETAILED DESCRIPTION OF THE INVENTION

The closing cylinder comprises initially a cylinder core 10, which includes a key guide 12 for the insertion of a key not shown in detail. The cylinder core 10 comprises chambers for closing followers not shown in detail, which normally stand in a blocking engagement with a bearing sleeve 20. The cylinder core 10 is rotatably supported in the bearing sleeve 20. The lever tumblers are set back through the inserted key, wherewith the cylinder core 10 can be rotated in the bearing sleeve 20 by way of the key.

The bearing sleeve 20 is supported axially fixed and rotatable in a cylinder housing 30, wherein the cylinder housing 30 comprises two housing shells 31, 32. In a normal case however, the bearing sleeve 20 rotatable in the cylinder housing 30 is fixed against rotation through an overload blocker 25, so long as a torque is exerted onto the cylinder core, where the torque is situated below a predetermined limiting torque. The components of such an overload blocker 25 can be best recognized from FIG. 4 and they comprise the following device components.

The overload blocker 25 comprises initially a release member, which is formed as a release lever 40 in the context of the present invention. The release member namely is pivotably supported at a circumferential position at 42 in the cylinder housing 30, as is shown in FIGS. 1 and 2. The release member has a locking cam 41 disposed opposite to this swivel bearing position 42, wherein the locking cam 41 tends to engage a snap in recess 21 at the inner front end 22 of the bearing sleeve 20 based on an axial spring loading 16 directed in the direction of the dash-dotted longitudinal axis 13. The release lever 40 is always non-rotatable positioned in the bearing housing 30 in the way to be described in more detail, therefore also the bearing sleeve 20 is non-rotatable in the normal case by the engagement of the locking cam 41 in the snap in recess 21.

In the normal case, where the overload blocker 25 is effective, therefore a rotation of the inserted key can be transferred from the cylinder core 10 to a driven member 35, which driven member 35 is rotatably supported at the inner end of the housing 30 as shown in FIGS. 1 and 2. A rotation of the driven member 35 is transferred over the shaft 36 connected to the driven member 35 to a function member in the vehicle, for example a vehicle lock in order to perform there the desired functioning in the vehicle.

The cylinder core 10 has a staggered cylinder inner end 14 best recognizable from FIG. 4 for the transition of the rotation, which cylinder inner end 14 is coupled to a carrier 50 in the normal case. This coupling comprises a coupling part 51, wherein the coupling part 51 is engaged with a counter coupling part 11 of the cylinder core 10 in a normal case. The coupling part is formed by a radial projection 51 according to the embodiment example of the invention, wherein the radial projection 51 points into the interior 52 of the ring of the carrier 50 formed here as a circular ring as can be best recognized from FIG. 3. The counter coupling part comprises an axial groove 11 in the staggered cylinder inner end 14 as can be recognized best from FIG. 4. The carrier 50 rests at the release lever 40, wherein the release lever 40 itself is formed as a circular ring. The circular ring of the carrier 50 has initially an axial flange 53 directed toward the outside as can be best recognized from FIG. 3, wherein the axial flange 53 in the mounted case rests at the circular ring from the release lever 40, as is shown in FIGS. 1 and 2. A radial collar 54 also exists at the axial flange 53 of the carrier 50, of the circular release lever recognizable from FIG. 3.

The rotation of the carrier 50 effected by the rotation of the key in a normal case is transferred to the driven member 35 through two connection means 57,37 standing always in engagement to each other. The carrier 50 has three webs 57 disposed parallel to the longitudinal axis 13 as a first connection means, wherein the webs 57 project at the inner front face from the annular body of the carrier 50. The second connection means comprise holes 37 running parallel to the axis in the driven member 35 as shown in FIG. 3. The webs 57 engage in the holes 37 of the driven member 35 not only in the normal case, but also in the overload case in the present situation.

The driven member 35 strives to pass into a defined zero position relative to the cylinder housing 30 by way of a so-called pulse spring 26, which can be recognized in FIGS. 1 and 2. For this purpose the pulse spring 26 has two legs 27, 28, which legs grip between themselves on the one hand an axial finger 38 of the driven member 35 and on the other hand a web 33 recognizable best in FIG. 6. After rotation of the key, which is only possible in the normal case, therefore the driven member moves back again into its starting rotary position and thereby takes also the cylinder core 10 into a corresponding zero position.

The hook piece 44 radially grips around the circular ring of the carrier 50 in the circumferential region and grips behind the circular ring in the assembly situation at its inner front face 56 as shown in FIG. 1. Thus there is generated from the release lever 40 and the carrier 50 a common swivel movable unit 55. However, the carrier 50 is rotatable relative to the release lever 40 in this swivel unit 55 as was mentioned above.

The release lever 40 and therewith the complete swivel unit 55 is held in a first swivel position in a normal case as recognizable from FIG. 1, wherein the first swivel position is marked by an auxiliary line 40.1. Then the already recited coupling between the locking cam 41 and the snap in recess 21 is present. This first swivel position can therefore be designated as "coupling swivel position". A connection fixed in axial direction exists between the release lever 40 and the carrier 50, wherein the connection fixed in axial direction consists of a hook piece 44.

The swivel axis 45 disposed at the swivel bearing position 42 is placed perpendicular to the release lever 40 and at a radial distance from the longitudinal axis 13 of the closing cylinder as is shown FIGS. 1 and 2. A bearing piece 46 is inserted in a radial sparing 34 of the cylinder housing 30 and serves for swivel support. The incorporation position of the bearing piece 46 is secured in the sparing 34 by the circumferential face of the bearing sleeve 20 as is shown in FIGS. 1 and 2. This alleviates the assembly of the closing cylinder according to the present invention.

In addition to the already recited locking cam 41 also a guide piece 48 is disposed opposite to the swivel bearing position 42 that is at the free arm end 47 of the release lever 40 shown in FIG. 4. This guide piece 48 engages into an inner recess 39 of the cylinder housing 30 in the assembly case recognizable in FIGS. 1 and 2. The guide piece 48 and the housing recess 39 take care of swivel guiding during swiveling of the release lever 40. The already recited fixed against rotation, but swivel movable guiding of the release lever 40 is obtained in the cylinder housing 30 both through the guide please 48 as well as through the swivel axis 45 at the bearing piece 46.

The previously described axial spring loading 16 attacks only at the arm end 47 of the release lever 40. For this purpose serves a pressure spring 15, which according to FIG. 1 is disposed in the previously recited inner recess 39 in the housing 30. The pressure spring 15 is supported on the one hand at the inner axial end of the recess 39 in the housing 30 and on the other hand at the support position 17 at the free end 47 of the arm of the release lever 40 as can be best seen in FIG. 4. This support position 17 is integrated into the previously recited guide piece 48. There a receptacle 18 is placed as shown in FIG. 4, which receptacle 18 receives at least a part piece of the pressure spring 15. The receiver 18 can continue in part also in the hook piece 44. The guide piece 48 is a nose, which is disposed in the circumferential region of the annular body of the release lever 40 and which projects perpendicular to a certain lever plane determined by the annular body of the release lever 40. The locking cam 41 is formed also at a nose generated by the guide piece 48, wherein the locking cam 41 belongs to the overload blocker. The hook piece 44 is also disposed in the region of the nose, however the hook piece 44 runs in an opposite direction to the locking cam 41.

An overload case is present were a torque is exerted on the cylinder core through break in tools and the like, wherein said torque amounts to more than the above recited limiting torque. The locking cam 41 and/or the locking recess 21 are in fact axially profiled, whereby run on bevels are generated between them. If the key is not plugged into the cylinder core, then the closing followers not shown in detail in the cylinder core 10 are engaged with the blocking grooves of the bearing sleeve 20. Then the cylinder core 10 is connected to the bearing sleeve 20 fixed against rotation, whereby the two device components 10, 20 are rotated together in the cylinder housing 30 with the break-in tools. Here the run on inclinations take care that the locking cam 41 becomes pressed out of the locking recess 21 against the spring loading 16. The free end 47 of the arm of the release lever 40 is transferred from a coupling swivel position 40.1 of FIG. 1 into a second swivel position 40.2 in FIG. 2 illustrated by the auxiliary line 40.2, since the release lever 40 with its locking cam 41 is moved over the run on inclinations of the locking recess 21 of the bearing sleeve 20. The second swivel position 40.2 therefore is the decoupling swivel position of the release lever 40.

The carrier 50 is given together in the decoupling swivel position 40.2 because of the swivel unit 55, with the consequence that the coupling 51 of the carrier 50 is decoupled off the counter coupling part 11 of the cylinder part 10. Therefore, a forced rotation of the cylinder core 10 in case of overload cannot any longer be transferred over the carrier 50 onto the driven member 35. In face of an overload the cylinder core rotates and the therewith fixed against rotation, bearing sleeve 20 in an idle motion relative to the decoupled swivel unit 55. The driven member 35 remains in a rest position. No functions in the vehicle can be triggered by the forced rotation of the cylinder core.

The angle of the key rotation of the cylinder core 10 is limited by limit stops 23, 24 at the driven member 35 in the present case, which can be recognized in FIG. 3. These limit stops 23, 24 are formed by the inner shoulders of a radial cutout 29 in a circumferential region of the driven member 35. An axial extension arm 19 is coordinated to this cutout 29 as can be recognized in FIG. 4, wherein the axial extension arm is seated at the housing 30. The inner radial recess 39 of the housing 30 for the guide piece 48 is disposed in part below the axial extension arm 19.

LIST OF REFERENCE CHARACTERS

10 cylinder core
11 counter coupling part; axial groove in 13 (FIG. 4)
12 key guide (FIG. 3)
13 longitudinal axis
14 inner end of cylinder of 10 (FIGS. 3,4)
15 pressure spring of 25 (FIG. 4)
16 elastic force of 40,55, spring loading (FIG. 2)
17 support position for 15 (FIG. 4)
18 receiver for 15 in 48 (FIG. 4)
19 axial extension arm at 30 (FIG. 4)
20 bearing sleeve
21 snap in recess in 20
22 inner front end of 20 (FIG. 4)
23 first limit stop of 35 for 19 (FIG. 3)
24 second limit stop of 35 for 19 (FIG. 3)
25 overload blocker (FIG. 4)
26 pulse spring for 35
27 first leg of 26
28 second leg of 26
29 radial cutout in 25 (FIG. 3)
30 cylinder housing
31 first housing shell of 30
32 second housing shell of 30 (FIG. 6)
33 axial web at 30 (FIG. 6)
34 sparing for 46 in 30 (FIGS. 1,2)
35 driven member
36 shaft at 35 (FIGS. 1,2)
37 second connecting means at 35, hole (FIG. 3)
38 axial finger at 35 for 27, 28 (FIGS. 1,6)
39 inner recess in 30 for 48 (FIGS. 1,2)
40 release lever
40.1 coupling swivel position of 40
40.2 decoupling swivel position of 40
41 locking cam at 40
42 first circumferential position of 40, swivel bearing position
43 anullar opening in 40 (FIG. 3)
44 hook piece at 40 (FIG. 4)
45 swivel axis between 42, 40 (FIGS. 1,2,4)
46 bearing piece 44 (FIGS. 1,2,4)
47 free arm end of 40 (FIGS. 2,4)
48 guide piece at 40 (FIGS. 1,2,4)
50 carrier
51 coupling part, radial projection
52 ring interior of 50, ring opening (FIG. 3)
53 axial flange of 50 (FIG. 3)
54 radial collar of 50 (FIG. 3)
55 swivel unit out all 40, 50 (FIGS. 1,2)
56 inner front face of 50 (FIGS. 1,4)
57 first connecting means at 50, web

The invention claimed is:

1. Closing cylinder for functions performable in a vehicle by way of a coordinated proper key, with a cylinder core (10) for insertion of the key for resetting closing followers in the cylinder core (10) from their blocking engagement in a bearing sleeve (20), wherein the cylinder core (10) is axially fixed, rotatably supported in the bearing sleeve (20) and wherein the bearing sleeve (20) is axially fixed, rotatably supported in a cylinder housing (30), with a release member belonging to an overload blocker (25), which release member is non-rotatable, however axially movably disposed in the cylinder housing (30), wherein the release member in a normal case, that is up to a certain limiting torque exerted onto the cylinder core (10), non-rotatable and fixedly holds the bearing sleeve (20) in the cylinder housing (30), since a profiled locking cam (41) is pressed against a counter profiled snap in recess (21) through a spring force (15), with a carrier (50), which carrier (50) is swiveling together with the release member (40), however is freely rotatable against the release member (40), wherein the carrier (50) exhibits a coupling part (51), which coupling part (51) is coupled to a counter coupling part (11) of the cylinder core (10) in a normal case, however in the overload case, that is with a torque exerted on the cylinder core (10), which torque is larger than the limiting torque, the carrier (50) is moved in axial direction by the release member, until the coupling part (51) is decoupled from the counter coupling part (11), and the carrier (50) is connected (57,37) fixed against rotation, however axially movable with a driven member (35) of the closing cylinder, in order to perform the desired functions in the vehicle, characterized in that the release member is pivotably supported at its one circumferential position (42) at the cylinder housing (30) and therefore operates as a release lever (40), which release lever (40) is set switchable between two swivel positions (40.1, 40.2) in an axial plane containing the longitudinal axis (13) of the closing cylinder, wherein a circumferential position of the release lever (40) disposed opposite to a swivel bearing position (42) forms a free end (47) of an arm, wherein the locking cam (41) and the snap in recess (21) are disposed in the region of the free end (47) of the arm between the release lever (40) and the bearing sleeve (20), wherein during pivoting the release lever (40) swivels together with the carrier (50) and wherein the release lever (40) together with the carrier (50) forms a common swivel unit (55), wherein the coupling part (51) of the carrier (50) is coupled to the counter coupling part (11) of the cylinder core (10) in the first one of the two swivel positions (40.1) which corresponds to the normal case of the swivel unit (55), however the coupling part (51) of the carrier (50) is decoupled from the counter coupling part (11) of the cylinder core (10) in the second swivel position (40.2) and which generates the overload case of the swivel unit (55).

2. Closing cylinder according to claim 1 wherein the spring force (15) effective between the locking cam (41) and the snap in recess (21) engages at the free end (47) of the arm of the release lever (40).

3. Closing cylinder according to claim 2 wherein a pressure spring (15) on the one end is supported by an inner shoulder of the cylinder housing (30) and on the other end is supported at a support position (17) of the release lever (40) and generates the spring force (15).

4. Closing cylinder according to claim 1 wherein a swivel axis (45) of the release lever (40) is disposed vertically relative to an axial plane determined by the longitudinal axis (13) and at a radial distance to the longitudinal axis (13) of the closing cylinder.

5. Closing cylinder according to claim 1, wherein a swivel axis (45) is seated at a bearing piece (46), which bearing piece (46) is disposed in a sparing (34) of the cylinder housing (30).

6. Closing cylinder according to claim 5, wherein the bearing piece (46) is loosely inserted into the sparing (34) and wherein the bearing piece (46) is held by a circumferential face of the bearing sleeve (20) in an incorporated position.

7. Closing cylinder according to claim 1, wherein a guide piece (48) is seated in the region of the free end (47) of the arm of the release lever (40), which guide piece (48) is guided in an inner recess (39) of the cylinder housing (30) upon swiveling of the swivel unit (55).

8. Closing cylinder according to claim 3, wherein a guide piece (48) forms at the same time a support position (17) for the pressure spring (15).

9. Closing cylinder according to claim 8, wherein the guide piece (48) exhibits a receiver (18), wherein at least a part piece of the pressure spring (15) is disposed in the receiver (18).

10. Closing cylinder according to claim 7, wherein the guide piece (48) comprises a nose, which nose projects at a right angle relative to a lever plane determined by the release lever (40).

11. Closing cylinder according to claim 10, wherein the locking cam (41) belonging to the overload blocker (25) is formed at the nose, and wherein a recess at an inner front face (22) of the bearing sleeve (20) is coordinated to the nose, which recess operates as a snap in recess (21) of the overload blocker (25).

12. Closing cylinder according to claim 7, wherein the swivel bearing position (42) of the release lever (40) and the guide piece (48) in its incorporating position in the housing recess (39) take care of a non-pivotability of the release lever (40).

13. Closing cylinder according to claim 1, wherein an axially fixed connection between the carrier (50) and the release lever (40) exists, which axially fixed connection makes the swivel unit (55) swivel-movable.

14. Closing cylinder according to claim 13, wherein the axially fixed connection comprises at least one hook piece (44), which hook piece (44) radially and axially grips around the circumference of the carrier (50), wherein the carrier (50) is ring shaped.

15. Closing cylinder according to claim 14, wherein the hook piece (44) is disposed in the region of a guide piece, however the hook piece (44) is directed opposite to the guide piece (48).

16. Closing cylinder according to claim 1, wherein the release lever and carrier are each ring-shaped.

17. Closing cylinder according to claim 1, wherein the circular ring of the release lever (40) is disposed in its coupling swivel position (40.1) characterizing the normal case in a radial plane of the closing cylinder, and wherein this circular ring in the decoupling swivel position (40.2) determining the overload case is tilted from this radial plane with its free end (47) of the arm toward the driven member (35) of the closing cylinder.

18. Closing cylinder according to claim 1, wherein a circular ring of the carrier (50) exhibits a radial projection (51) pointing to an interior (52) of the ring, and wherein the radial projection (51) forms the coupling part of the carrier (50)

and wherein the counter coupling part comprises an axially disposed groove (11) at a staggered inner end (14) of the cylinder core (10).

19. Closing cylinder according to claim 16, wherein the circular ring of the carrier (50) comprises an outwardly pointing axial flange (53), wherein the axial flange (53) is furnished with a radial collar (54) enclosing an annular opening (52) of the carrier (50).

20. Closing cylinder according to claim 1, wherein axially parallel running holes (37) and webs (57) engaging into the holes (37) are disposed between the driven member (35) and the swivel movable carrier (50) wherein the driven member (35) and the carrier (50) are jointly rotatable, however the carrier (50) relative to the driven member (35) is swivelable in a plane determined by the longitudinal axis (13).

21. Closing cylinder according to claim 1, wherein the cylinder housing (30) is subdivided in longitudinal direction and comprises two housing shells (31,32), which housing shells (31,32) serve for furnishing a rotary bearing of the bearing sleeve (20).

22. A closing cylinder for functions performable by way of a coordinated proper key, comprising a bearing sleeve (20);

a cylinder core (10) for insertion of the key for resetting closing followers in the cylinder core (10) from their blocking engagement in the bearing sleeve (20), wherein the cylinder core (10) is axially fixed, rotatably supported in the bearing sleeve (20);

a cylinder housing (30) supporting the bearing sleeve (20) axially fixed and rotatably;

a release member (40) belonging to an overload blocker (25), which release member is non-rotatable, however axially movably disposed in the cylinder housing (30);

wherein the release member in a normal case, that is up to a certain limiting torque exerted onto the cylinder core (10), non-rotatable and fixedly holds the bearing sleeve (20) in the cylinder housing (30), since a profiled locking cam (41) is pressed against a counter profiled snap in recess (21) through a spring force (15);

a carrier (50) swiveling together with the release member (40), however is freely rotatable against the release member (40), wherein the carrier (50) exhibits a coupling part (51), which coupling part (51) is coupled to a counter coupling part (11) of the cylinder core (10) in a normal case, however in the overload case, that is with a torque exerted on the cylinder core (10), which torque is larger than the limiting torque, the carrier (50) is moved in axial direction by the release member, until the coupling part (51) is decoupled from the counter coupling part (11);

wherein the carrier (50) is connected (57, 37) fixed against rotation, however axially movable with a driven member (35) of the closing cylinder, in order to perform the desired functions;

wherein the release member (40) is pivotably supported at its one circumferential position (42) at the cylinder housing (30) and therefore operates as a release lever (40), which release lever (40) is set switchable between two swivel positions (40.1, 40.2) in an axial plane containing the longitudinal axis (13) of the closing cylinder;

wherein a circumferential position of the release lever (40) disposed opposite to a swivel bearing position (42) forms a free end (47) of an arm, wherein the locking cam (41) and the snap in recess (21) are disposed in the region of the free end (47) of the arm between the release lever (40) and the bearing sleeve (20);

wherein during pivoting the release lever (40) swivels together with the carrier (50) and wherein the release lever (40) together with the carrier (50) forms a common swivel unit (55);

wherein the coupling part (51) of the carrier (50) is coupled to the counter coupling part (11) of the cylinder core (10) in the first one of the two swivel positions (40.1), which corresponds to the normal case of the swivel unit (55), however the coupling part (51) of the carrier (50) is decoupled from the counter coupling part (11) of the cylinder core (10) in a second swivel position (40.2) and which generates the overload case of the swivel unit (55).

* * * * *